United States Patent [19]

Di Loreto

[11] 4,418,842

[45] Dec. 6, 1983

[54] CHILD RESISTANT CLOSURE

[75] Inventor: Joseph Di Loreto, Yonkers, N.Y.

[73] Assignee: Precision Valve Corporation, Yonkers, N.Y.

[21] Appl. No.: 249,630

[22] Filed: Mar. 31, 1981

[51] Int. Cl.[3] ..... B65D 83/14; B67D 5/32

[52] U.S. Cl. ..... 222/153; 222/182; 222/402.11

[58] Field of Search ..... 222/182, 153, 402.1, 222/402.11, 393, 402.17; 215/220

[56] References Cited

U.S. PATENT DOCUMENTS 2,887,273 5/1959 Anderson ..... 222/402.17

3,180,536 4/1965 Meshberg ..... 222/402.17

*Primary Examiner*—Robert B. Reeves

*Assistant Examiner*—Russell D. Stormer

*Attorney, Agent, or Firm*—Davis, Hoxie, Faithfull & Hapgood

[57] ABSTRACT

A child resistant actuator cap for a pressurized aerosol dispenser or the like operates in only one relative alignment of the cap and a collar affixed to the container. Alignment is signalled to the user by a predetermined number of clicks of a flexible blade following a blank space which produces no clicks.

5 Claims, 4 Drawing Figures

CHILD RESISTANT CLOSURE

BACKGROUND

Pressurized aerosol dispensers sometimes are filled with products which, in the hands of a child, can be harmful. Paint, oven cleaners, and insecticides are examples of such products. Much effort has been devoted to safety devices which render operation of the dispenser difficult or impossible for a youngster. Some devices depend upon the difference in size or strength between the hands of adults and children, however, children with large or strong hands are not prevented and adults with small or weakened hands are. Others depend upon following instruction to align two reference points whereby actuation is permitted. Some of these are too simple to be effective in preventing children from operating the dispenser. Others are so complex as to annoy the adult user. Still others require the user to peer down a hole to see a spot or other alignment indicium; a difficult chore in poor light or for those with less than perfect vision. The present invention provides a child-resistant actuator of the type requiring alignment and also requires the comprehension of written instructions by the user. Once understood, the device can be aligned or unlocked without the need for vision. It is simple enough for adults, but not easily defeated by children not yet able to read and follow directions.

BRIEF SUMMARY OF THE INVENTION

An actuator cap for a pressurized aerosol dispenser is prevented from actuation by abutment of a depending blade or rib within the cap body against a shoulder or ledge on a collar surrounding the valve pedestal of the container. In only one relative alignment of cap and container is the blade or rib in alignment with a notch or slot extending through the shoulder. Only in that aligned condition is the actuator capable of operation to dispense the product.

To achieve the necessary alignment, the user must follow instructions which may be printed on the container label. The user must rotate the cap with respect to the container in a particular direction and observe clicks caused by the blade snapping over notches or other detents circumferentially arranged on the collar affixed to the container. The absence of clicks signals the user to count a predetermined number of clicks from that blank region. At the requisite count, the cap is in alignment with a deeply extending slot lacking the abutment shoulder and the dispenser can be actuated.

The present invention requires a collar to be affixed to the container, preferably about the pedestal portion of the valve mounting cup, and requires a minor modification of the actuator cap to include the flexible blade which causes the clicks. Different collars can have different predetermined numbers of detents or notches in advance of the alignment slot to enable different click codes for different products.

DESCRIPTION OF PREFERRED EMBODIMENTS

Figure 1:
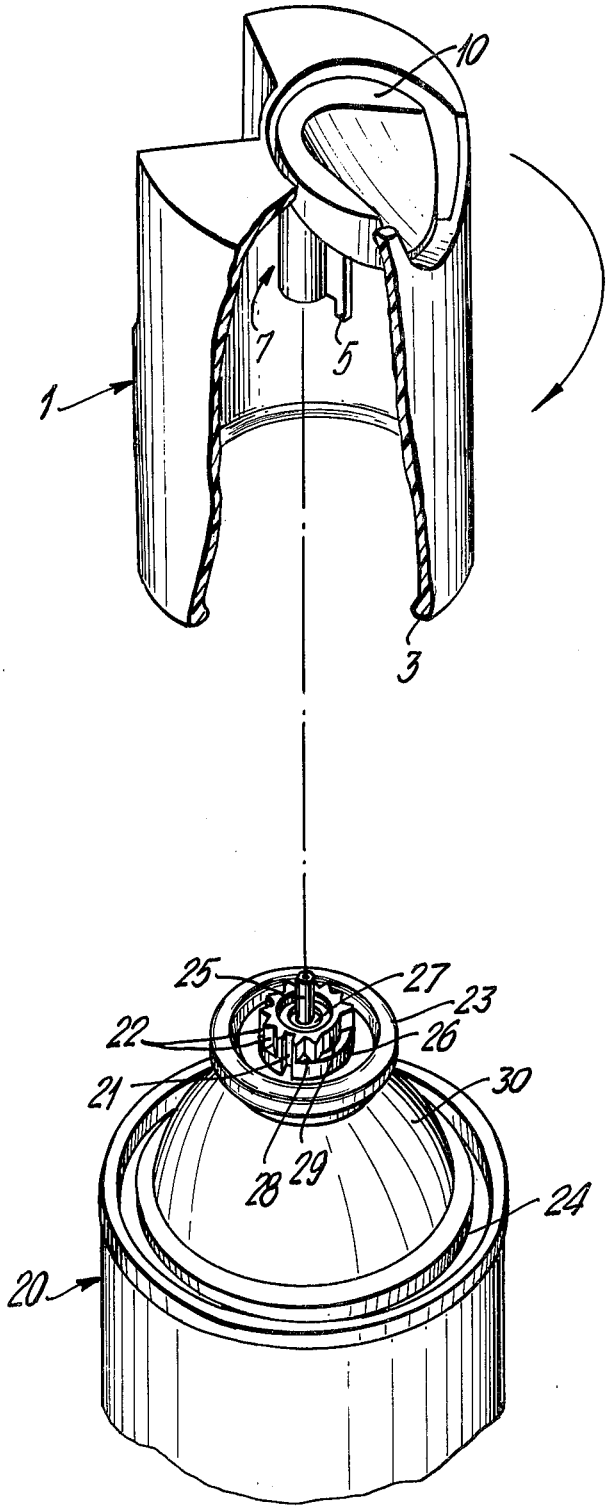
FIG. 1 is a perspective view of the cap and container according to a first embodiment. The cap is partially broken away and is separated from the container for clarity.
Figure 2:
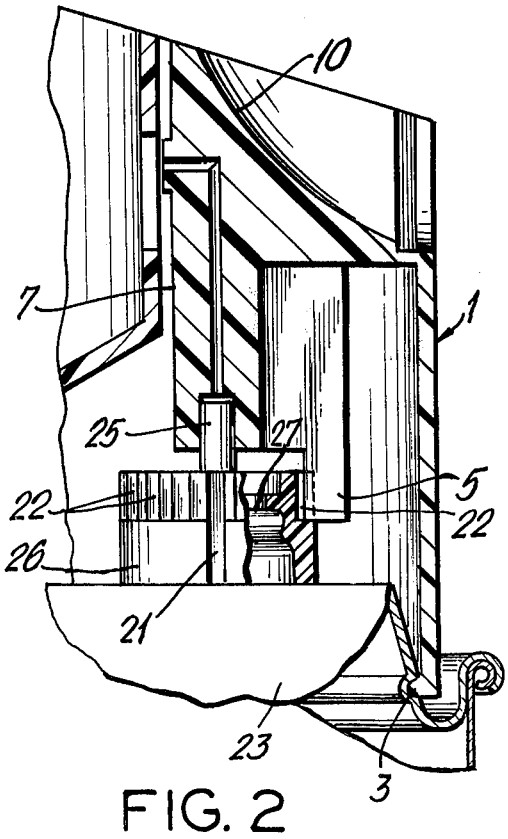
FIG. 2 is a partial view in cross-section of the cap of the first embodiment.

FIGS. 1 and 2 illustrate an embodiment of the present invention. A molded plastic actuator cap 1 having a finger depressible actuator portion 10 is fitted to a pressurized aerosol dispenser container 20 such that the central portion 7 associated with the depressible portion 10 receives the upstanding tubular valve stem 25 of the container, thereby permitting actuation of the valve by depression of portion 10. Product released from the container valve is conducted through passageways in the cap 10 to issue as a spray, stream, or foam from an appropriate discharge orifice in the cap. The structure thus far described is conventional. To render this conventional structure resistant to operation by children is the purpose of the present invention.

The container 20 is provided with a molded plastic collar 26 which fits over the upstanding pedestal portion 27 of the conventional valve mounting cup 23. The upper portion of the collar 26 is serrated by detent splines or notches 22 and resembles a gear wheel. The notches 22 terminate at a shoulder 28 on the lower portion of the collar. The notches are interrupted by a blank region 29 lacking notches, but having the shoulder 28. Proximate the blank region 29, but spaced therefrom by a predetermined number of intervening notches 22, is a single deeply extending notch or slot 21 which extends downwardly through the shoulder 28 and into the lower region of the collar 26. The collar 26 is prevented from rotation with respect to the pedestal by means such as adhesive or protrusions extending radially inwardly which interfit with the crimped depressions found in the cylindrical wall of the conventional valve mounting cap pedestal.

The cap 1 is fitted on the container 20 with the valve stem 25 in communication with the cap product passageways. An inwardly extending lip 3 snap-fits into an annular groove 24 undercut in the dome top 30 of the container. The cap is free to rotate with respect to the container and to the collar 26 fixed to the container.

A flexible blade 5, integral with the cap actuator portion 7, 10 engages the notches 22 of the collar 26. As the cap 1 is rotated with respect to the container 20, the flexible blade 5 flexes and snaps from notch to notch producing an audible click which is also tactilely perceivable by the user.

In operation, the actuator portion 10 is prevented from depression by abutment of the blade 5 with the shoulder 28 which forms the bottom of all slots 22 except a single deeply extending notch 21. Actuation of the container valve is prevented in all positions except when blade 5 is aligned with deeply extending notch 21.

To align the blade 5 with notch 21, the user must follow instructions since the alignment condition cannot be seen. The instructions direct the user to rotate the cap in the direction (here clockwise) until the clicks stop, indicating that the blade is in the blank region 29 of the collar 26. The user is instructed to continue rotation in the instructed direction for a predetermined number of clicks (here two) subsequent to the click-free blank region. At that time, the blade 5 is aligned with deeply extending notch 21 and actuation can occur since the depressible portion 10 is no longer blocked from depression by the shoulder.

The user, once instructed, can operate the dispenser by recalling how many clicks past the blank to turn the cap. The device can be operated in poor light since visibility is not required. Since the clicks can be felt as well as heard, the dispenser can be operated in noisy environments.

Children capable of reading and following written instructions can operate the dispenser, but those children not yet old enough cannot. It is those younger children who are to be prevented from operating the dispenser.

Figure 3:
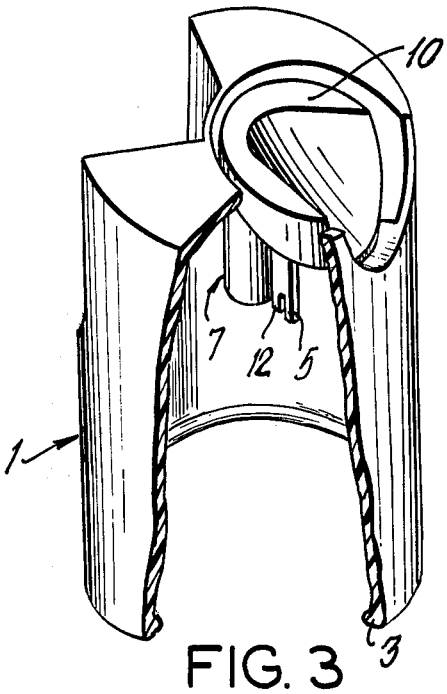
FIG. 3 is a perspective view, partly broken away, of a second embodiment.
Figure 4:
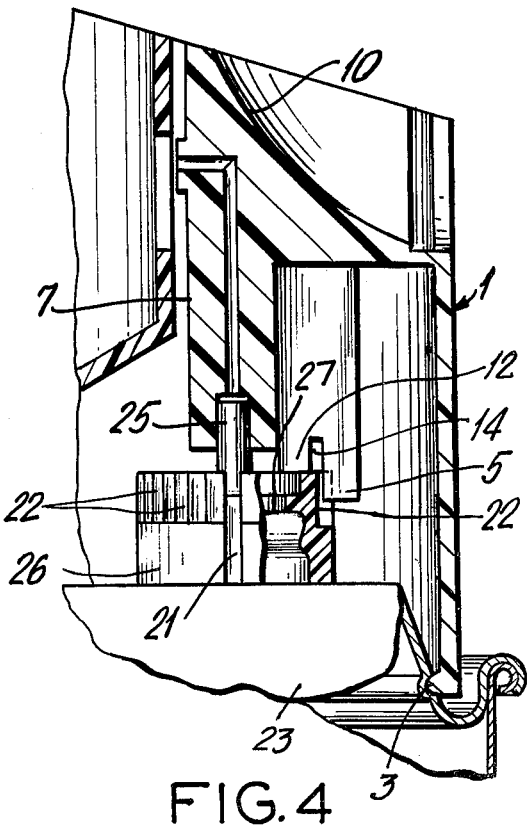
FIG. 4 is a partial view in cross-section of the cap of the second embodiment.

In the embodiment shown in FIGS. 3 and 4, a modification of the blade 5 is the only difference from the embodiment of FIGS. 1 and 2. The flexible, depending blade 5 is separated by a slot 14 from a protrusion or rib 12. Rib 12 abuts the top surface of the collar 26 while blade 5 snaps to provide clicks. The rib 12 can be rugged and stiff compared with the flexible blade 5. This embodiment better resists forceful efforts to actuate the dispenser in positions other than alignment with deeply extending slot 21. The rib 12 and blade 5 need not be in the same plane, but can be circumferentially separated.

The child resistant actuator of the present invention is described in the context of a pressurized aerosol dispenser, but could, without difficulty, be adapted to closures such as screw caps and to dispenser pumps as well.

We claim:

1. A child resistant closure for a pressurized aerosol dispenser comprising an actuator cap rotatable with respect to the dispenser container and a collar affixed to the container, the collar having a plurality of circumferentially arranged detents, a blank space having no detents, a shoulder, and a vertical slot associated with a predetermined detent and extending through the shoulder, said cap having a flexible blade arranged to cooperate with the collar detents to produce clicks as the collar is rotated, said cap having means to abut the shoulder which means cooperate with the collar slot when aligned with the slot to permit actuation of the dispenser.

2. The child resistant closure of claim 1 wherein the means to abut the shoulder is a flexible blade.

3. The child resistant closure of claim 1 wherein the means to abut the shoulder comprises a rib having an outer flexible portion which is received in the slot.

4. The child resistant closure of claim 2 wherein the means to abut the shoulder comprises a rib and the flexible blade is circumferentially displaced from the rib.

5. The child resistant closure of claim 1 wherein the detents are vertically extending notches which terminate at the shoulder.

* * * * *